United States Patent [19]

Barrois

[11] 4,056,192

[45] Nov. 1, 1977

[54] DISPLAY DEVICE FOR SPECTACLES

[75] Inventor: Marcelle Barrois, Garches, France

[73] Assignee: Techniform, Nanterre, France

[21] Appl. No.: 705,551

[22] Filed: July 15, 1976

[51] Int. Cl.[2] ..... A47F 7/02

[52] U.S. Cl. ..... 211/13; 248/DIG. 2

[58] Field of Search ..... 211/13, 60 T, 120; 206/5, 6, 45.14, 75, 338, 340, 523; 24/3 C, 81 CC; 248/DIG. 2, 114, 115, 116

[56] References Cited

U.S. PATENT DOCUMENTS

| | | | |
|---|---|---|---|
| 484,608 | 10/1892 | Pfouts | 206/338 |
| 1,774,430 | 8/1930 | Flier | 206/75 |
| 2,548,289 | 4/1951 | Carraher | 211/13 |
| 3,333,708 | 8/1967 | LeBlanc et al. | 248/DIG. 2 |
| 3,352,425 | 11/1967 | Burke | 248/DIG. 2 |
| 3,858,726 | 1/1975 | Rosenwein | 248/DIG. 2 |

*Primary Examiner*—Roy D. Frazier
*Assistant Examiner*—Terrell P. Lewis
*Attorney, Agent, or Firm*—George H. Mitchell, Jr.

[57] ABSTRACT

A display device for supporting spectacles comprises a core member which is arranged to be straddled by a frame of the spectacles to be displayed and the width of which equals or slightly exceeds the center-to-center distance between hinges of the frame, and forcing means situated behind the core member for forcing ends of side-pieces of the spectacles towards one another beyond a point whereat the side-pieces are to be supported on the core member.

5 Claims, 2 Drawing Figures

DISPLAY DEVICE FOR SPECTACLES

FIELD OF THE INVENTION

The present invention relates to a display device for spectacles, more particularly ophthalmic, or frames for such spectacles.

DESCRIPTION OF THE PRIOR ART

The first previously proposed display devices used for this purpose were dummy heads on which the frame was placed as if on a human head.

A fashion for sunglasses has demanded use of simpler, cheaper display devices, for example simple panels of cardboard, wood, metal, or plastics formed with holes through which side-pieces of the spectacles are passed.

In general display devices of the types mentioned above are not aesthetically satisfying and are out of place in high-class shops, particularly since the spectacles are untidy when inadequately fixed.

Display devices recently proposed comprise a cushion of approximately the same width as a frame of the spectacles. At least sides of the cushion are resilient, and the cushion co-operates with lateral supports to form two narrow slots having at least one resilient surface. The side-pieces of the frame to be displayed are engaged in the slots.

More particularly, such display devices have been made by placing of cushions with resilient sides one beside the other with engagement of the side-pieces of the frames between them.

Experience has shown that fixing of the side-pieces between two resilient surfaces (let alone one resilient and one rigid surface) was quite inadequate to prevent the frames mounted on one cushion from falling out of line, so that the use of such a display device was out of the question.

We note that the frames have fallen out of line because a single cushion has been straddled by frames of different widths, and because for some of the frames resilient deformation of material covering a core member has not been sufficient to provide adequate seating for the side-pieces.

The situation was aggravated when the side-pieces were introduced between two core members with resilient sides. This not only caused the frames to fall out of line as stated above, but also made them tilt forwards in an unattractive manner.

It is an object of the present invention to provide a display device for spectacles, wherein the above-indicated disadvantage is eliminated or substantially reduced.

SUMMARY OF THE INVENTION

According to the present invention, therefore, we provide a display device for spectacles, comprising a core member which is arranged to be straddled by a frame of spectacles to be displayed and the width of which equals or slightly exceeds the centre-to-centre distance between hinges of the frame, and forcing means situated behind the core member for forcing ends of side-pieces of the spectacles towards one another beyond points whereat the side-pieces are to be supported on the core member.

In the present display device, the core member and the forcing means constitute a support.

DESCRIPTION OF SPECIFIC EMBODIMENTS

The invention will now be more particularly described with reference to the accompanying drawing, wherein.

Figure 2:
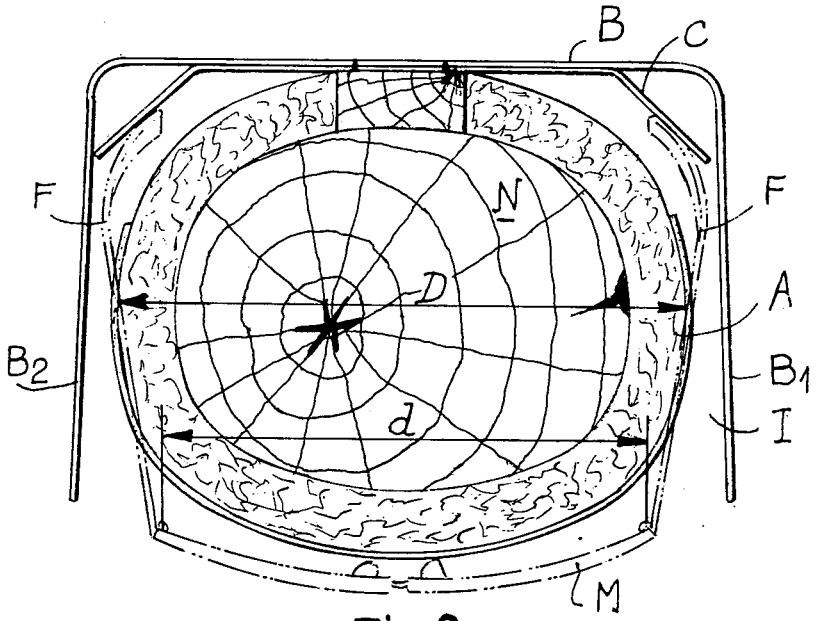
FIG. 2 is a horizontal cross-sectional view of the display device shown in FIG. 1.

As the drawing shows, a display device has an elliptical or part-elliptical core member N (FIG. 2) covered with deformable material in the form of a layer A of polyurethane foam, positioned centrally in a box B with a U-shaped cross-section so as to leave a gap I between the layer A and inside surfaces of side walls $B_1$, $B_2$ of the box B. Other deformable material may alternatively be used.

Figure 1:
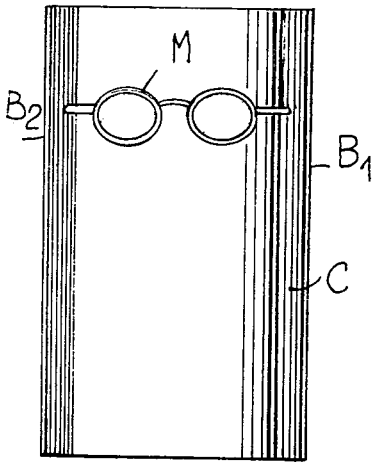
FIG. 1 is an elevation of a display device for spectacles.

The width D of the core member N and of its foam layer A is equal to or slightly greater than the centre-to-centre distance *d* between hinges of a frame M (FIG. 1).

The box B (FIG. 2) narrows beyond the longitudinal axis of the core member N and has an integral member C positioned obliquely across each corner of the box B. Alternatively, the member C may optionally be absent, or the box B may not thus narrow.

The frame M is applied to a front surface of the core member N, describing a semi-ellipse, side-pieces F thereof are introduced into gaps such as the gap I, and ends thereof are brought towards the centre when they encounter oblique surfaces of the member C. This and the fact that D is greater than *d* causes the side-pieces F to sink into the foam layer A, forming two furrows which impede vertical movement of the side-pieces F.

The member C may be covered with a material having a high coefficient of friction, so that the resilience of the side-pieces F does not cause them to come out.

The walls $B_1$, $B_2$ constitute parts of forcing means shaped so as to bring the side-pieces F towards the centre of the spectacles beyond points whereat they are supported on the member N.

The box B may be partially polygonal or elliptical.

I claim:

1. A display device for spectacles, comprising a core member to be straddled by the frames of spectacles to be displayed, said core member having, normally convex, opposed side surfaces and including a layer of inwardly deformable material disposed thereon for contact with the respective side-pieces of said spectacles, the normal width of said core member being at least equal to the centre-to-centre distance between hinges of the frames, whereby said side-pieces form furrows in said layer when mounted on said core member, and forcing means situated for engagement with the free ends of the side-pieces to urge said free ends toward each other when the spectacles are so mounted.

2. A display device according to claim 1, wherein a box having a generally U-shaped cross-section partially surrounds the sides and rear of said core member, said core member being centrally positioned with respect to the box and the box being of a size such as to leave a gap between the core member and the side walls of the box, said forcing means comprising a portion of the walls of the box which are shaped for engagement with the side-pieces of the spectacles rearwardly of the area where the side-pieces engage the side surfaces of the core member.

3. A display device according to claim 2, wherein said forcing means comprises a member extending obliquely across the portions of the U-shaped box where the legs join the base of the U.

4. A display device according to claim 3, wherein the cross-section of the box is partially polygonal.

5. A display device according to claim 3, wherein the cross-section of the box is partially elliptical.

* * * * *